United States Patent [19]

Shinji et al.

[11] Patent Number: 4,688,735

[45] Date of Patent: Aug. 25, 1987

[54] PAPER TUBE SUPPLY SYSTEM

[75] Inventors: Noshi Shinji; Akio Matsushima, both of Kyoto, Japan

[73] Assignee: Murata Kikai Kabushiki Kaisha, Kyoto, Japan

[21] Appl. No.: 919,627

[22] Filed: Oct. 15, 1986

Related U.S. Application Data

[63] Continuation of Ser. No. 495,752, May 18, 1983, abandoned.

[30] Foreign Application Priority Data

May 21, 1982 [JP] Japan ..... 57-86840

[51] Int. Cl.[4] ..... B65H 54/20; B65H 54/26; B65H 67/06

[52] U.S. Cl. ..... 242/35.5 A; 198/797; 221/219; 221/221; 414/128

[58] Field of Search ..... 242/35.5 A, 35.5 R, 242/35.6 R; 414/128; 221/219, 220, 221, 222, 223, 217; 198/797, 801

[56] References Cited

U.S. PATENT DOCUMENTS

| | | | |
|---|---|---|---|
| 1,704,318 | 3/1929 | Gregory | 221/221 |
| 2,017,521 | 10/1935 | Whiting, Jr. | 221/221 |
| 3,120,324 | 2/1964 | Amberg et al. | 221/221 |
| 3,181,728 | 5/1965 | West et al. | 221/221 |
| 4,066,218 | 1/1978 | Kamp | 242/35.5 A |
| 4,139,108 | 2/1979 | Kamp et al. | 242/35.5 A |
| 4,155,513 | 5/1979 | Maassen | 242/35.5 A |

FOREIGN PATENT DOCUMENTS

| | | | |
|---|---|---|---|
| 2131957 | 2/1973 | Fed. Rep. of Germany | 242/35.5 A |
| 61275 | 5/1981 | Japan | 242/35.5 A |

*Primary Examiner*—Stanley N. Gilreath
*Attorney, Agent, or Firm*—Spensley Horn Jubas & Lubitz

[57] ABSTRACT

A system for automatically supplying tapered paper tubes to an automatic winder which includes a number of winding units. The system includes a paper tube discharging device which provide a stock section for retaining tapered tubes in heaped up condition and a releasing section for separating lowermost ones of the heaped up paper tubes in the stock section. The separated paper tubes are transported one by one along a paper tube transporting path and fed to each winding unit.

4 Claims, 17 Drawing Figures

PAPER TUBE SUPPLY SYSTEM

This is a continuation of applicaition Ser. No. 495,752 filed on May 18, 1983, now abandoned.

BACKGROUND OF THE INVENTION

This invention relates to a paper tube supply system, and more particularly to a system for automatically supplying tapered paper tubes to an automatic winder.

An automatic winder which includes a number of winding units therein is already known. In an automatic winder of this type, a plurality of cops from which yarns are to be supplied are stored in a cop magazine provided for each winding unit. The magazine operates in response to a cop supplying instruction to supply a cop to an associated winding unit. In order to supply cops to magazines, a travelling truck is employed. Such a travelling truck has a number of cops loaded thereon and travels along the winding units while it automatically supplies cops to a magazine in response to a request therefrom.

In the meantime, an apparatus is also known which operates, in response to completion of full winding on a package, to doff the fully wound package and to release and supply a paper tube from a paper tube retaining section for storing therein paper tubes on which yarns drawn from cops are taken up or wound. According to the apparatus, each unit must include such a paper tube retaining section and a discharging device. As a result, the apparatus is necessarily made complicated, and sometimes travelling of an automatic doffing device, as a doffer, of the type which travels along winding units is obstacled by such retaining sections and discharging devices. Moreover, supply of paper tubes to the paper tube retaining section of each unit is effected by manual operation and hence is very troublesome. Accordingly, instead of provision of each winding unit with a paper tube retaining section, a travelling car having a doffer thereon is also used; paper tubes are contained in the travelling car and upon doffing, a paper tube is released and supplied.

In this case, it is a problem that there is a significant difference in the number of cops which can be contained in a travelling car depending upon the configuration of cops. For example, paper tubes or bobbins for cheeze packages have a cylindrical configuration and hence have no directionality. Accordingly, a great number of paper tubes can be contained within a particular space, and hence a single storing operation will allow automatic doffing over a long period of time.

However, in case of tapered cone paper tubes for cone packages, paper tubes must be separated individually in regulated orientations when stored in a doffing truck, and hence the quantity of paper tubes storable in the doffing truck is limited to several in number. Accordingly, it is necessary to frequently effect supply of paper tubes to a travelling car. Thus, it has been a subject to be resolved to provide efficient means for storing and transporting a large quantity of tapered paper tubes supplied.

SUMMARY OF THE INVENTION

The present invention relates to a system for automatically supplying tapered paper tubes to an automatic winder which includes a number of winding units therein.

An object of the present invention is to provide efficient means for storing and supplying a large quantity of tapered paper tubes to winding units automatically.

The present invention provides a system wherein a plurality of lots each including a number of paper tubes heaped up one on another into the form of a tower in order to make use of characteristics of tapered paper tubes are provided at a location on a side of an automatic winder, and when necessary, a paper tube is released from the lots and is fed to a paper tube containing box of a travelling car by a suitable transporting means.

A paper tube supply system according to the present invention comprises, between a winder including a plurality of winding units therein and a paper tube discharging device including a stock section for retaining tapered paper tubes in heaped up conditions and a releasing section for separating lowermost ones of the heaped up paper tubes in said stock section from the remaining paper tubes above, a paper tube transporting path for feeding therealong the thus separated paper tubes one by one. Accordingly, only if paper tubes in a large quantity are stocked in the paper tube discharging device, supply of paper tubes to every winding unit of the winder can be effected automatically.

DETAILED DESCRIPTION OF THE INVENTION

A preferred embodiment of the present invention will be described in the following with reference to the accompanying drawings.

Figure 1:
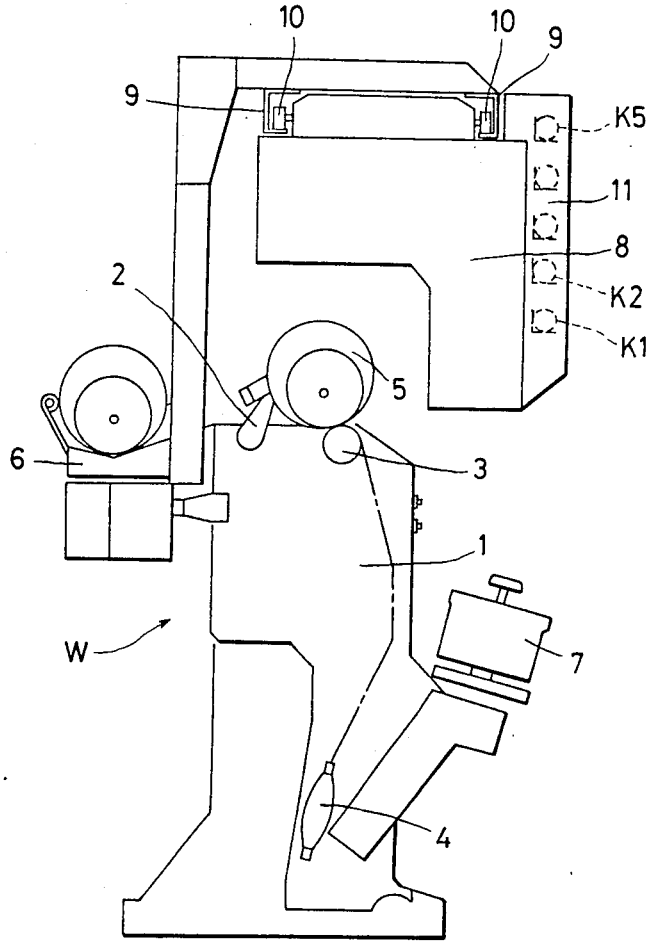
FIG. 1 is a side elevational view, in diagrammatic representation, showing a relationship between a winding unit and a travelling car.
Figure 2:
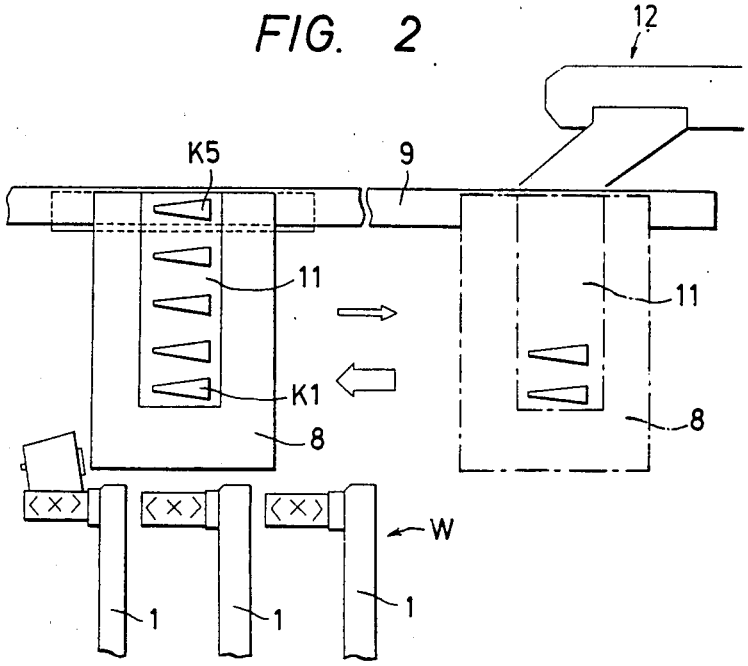
FIG. 2 is a front elevational view of the arrangement of FIG. 1.

FIGS. 1 and 2 illustrate relationships between an automatic winder and a travelling car. The winder shown includes a plurality of winding units 1 therein. In FIG. 1, the winding unit 1 is shown as being disposed to extend in a direction perpendicular to the drawing and includes a cradle arm 2. A paper tube supported on the cradle arm 2 is rotated by means of a traverse drum 3 to take up thereon a yarn drawn from a cop 4 below. When a predetermined quantity of a yarn has been taken up on the paper tube, the fully wound package 5 thus obtained is removed from the cradle arm and discharged onto a package storing plate 6 behind the unit. And a new paper tube is supplied to the cradle arm in order to start winding again. If a yarn has been unwound completely from the cop 4, then a cop is dropped to be supplied from a cop magazine 7 which is provided for each winding unit for storing cops therein.

A pair of ceiling rails 9 are disposed to extend along the winding units 1, and a travelling car 8 is supported on and depends from the ceiling rails 9 by means of wheels 10 so that it can travel along the rails 9. The travelling car 8 has a doffer and a paper tube supplying device thereon and is designed to stop at a position adjacent each winding unit in order to effect doffing and empty paper tube supplying operations there. In empty paper tube supplying operation, paper tubes K1 to K5 which are stored separately in regulated orientation in an empty paper tube containing box 11 of the travelling car are supplied in order beginning from the lowermost one thereof to each unit by means of a discharging device not shown.

Referring to FIG. 2, a paper tube supplying section 12 of a paper tube supply device is disposed adjacent an end of the winder. The travelling car 8 is reversed at opposite end positions of the winder W to effect traversing travelling, and when it comes to the paper tube supplying section, it will be once stopped there and supplied with paper tubes if less than a predetermined quantity of paper tubes remain in the containing box 11 thereof. FIG. 2 diagrammatically shows five paper tubes remain in the containing box, and since two paper tubes remain in the travelling car 8 which is at the paper tube supplying position, further three paper tubes will be supplied to the travelling car 8 at this position.

In the followings, an embodiment of the paper tube supply device for supplying paper tubes as mentioned hereinabove will be described in detail.

Figure 3:
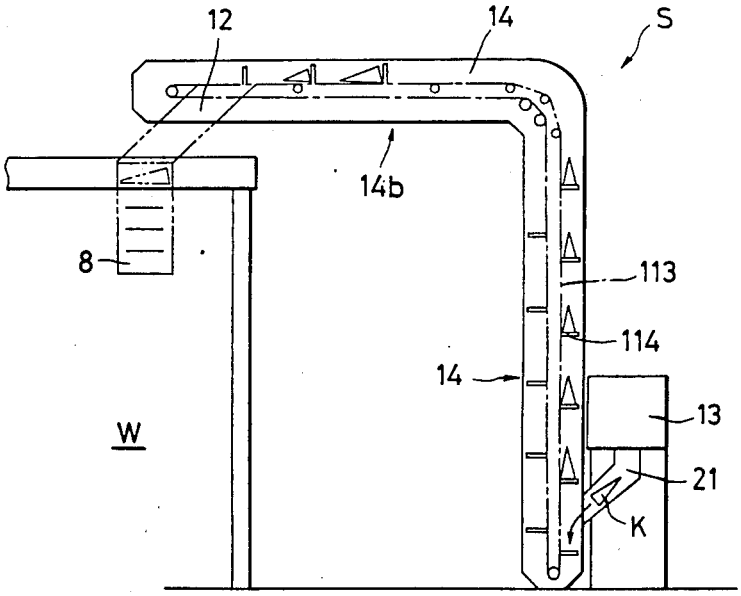
FIG. 3 is a diagrammatic representation of the layout showing an embodiment of a system according to the present invention.

Referring to FIG. 3, a paper tube supply system S includes a discharging device 13 for retaining and releasing paper tubes, a transporting device 14 for individually feeding discharged paper tubes, and the supplying section 12 for supplying paper tubes to the travelling car 8.

Figure 4:
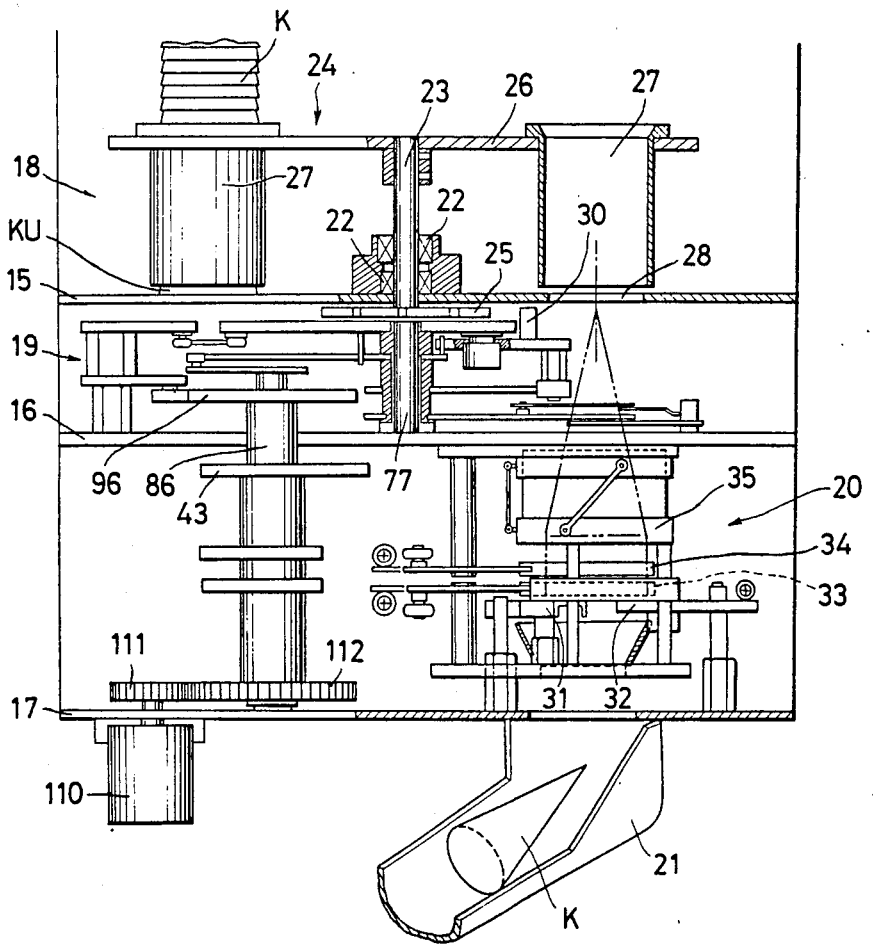
FIG. 4 is a front elevational view, in diagrammatic representation, showing an embodiment of a paper tube discharging device.

The paper tube discharging device 13 will now be described with reference to FIG. 4. The discharging device 13 divided into three sections, i.e., a paper tube stock section 18, a driving section 19 for moving a magazine, and a releasing section 20 for releasing a paper tube from a heap of paper tubes, by means of partition plates 15, 16 and 17. A paper tube K thus released is fed to the transporting device 14 of FIG. 3 by way of a chute 21.

The paper tube stock section 18 includes a shaft 23 extending through the partition plate 15 and supported for rotation by means of bearings 22, a magazine 24 secured to the top end of the shaft 23, and a latch wheel 25 secured to the bottom end of the shaft 23 and having a plurality of latches formed along an outer periphery thereof. The magazine 24 includes bottomless cylinders 27 which are inserted in holes formed in circumferentially equally spaced relationship in a disk 26 and are thus supported by the disk 26, and the magazine in the embodiment includes, for example, up to six cylinders 27 supported on the disk 26 in angularly equally spaced relationship by an angle of 60 degrees. A through-hole 28 is formed in a portion of the partition plate 15 which is just below one of the cylinders 27 in a certain position so as to allow a paper tube to drop therethrough to the discharging device below.

Figure 11:
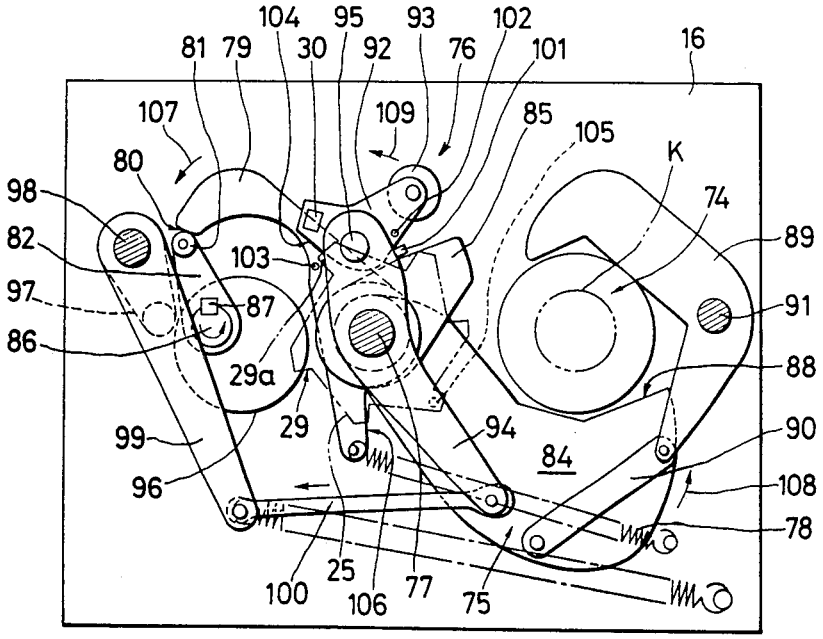
FIG. 11 is a plan view showing the construction of a magazine feeding driving section 19.

The latch wheel 25 has six latches 29 formed around an outer periphery thereof as shown in FIG. 11 which latches 29 are engaged by a latch pin 30, which will be described hereinafter, so as to provide intermittent rotation of the latch wheel 25. In each of the bottomless cylinder 27, a number of conical paper tubes K are contained in a heaped up tower-like condition with their smaller diameter portions direction upwardly. A lowermost one of the paper tubes K bears against and is placed on the partition plate 15 so that the paper tubes will be slidingly fed on the partition plate 15 by intermittent rotation of the shaft 25. Each of the cylinders can store therein, for example, about 50 paper tubes K which are tapered at an angle of 9°15′, and hence about 300 paper tubes K can be stored in the magazine.

Figure 5:
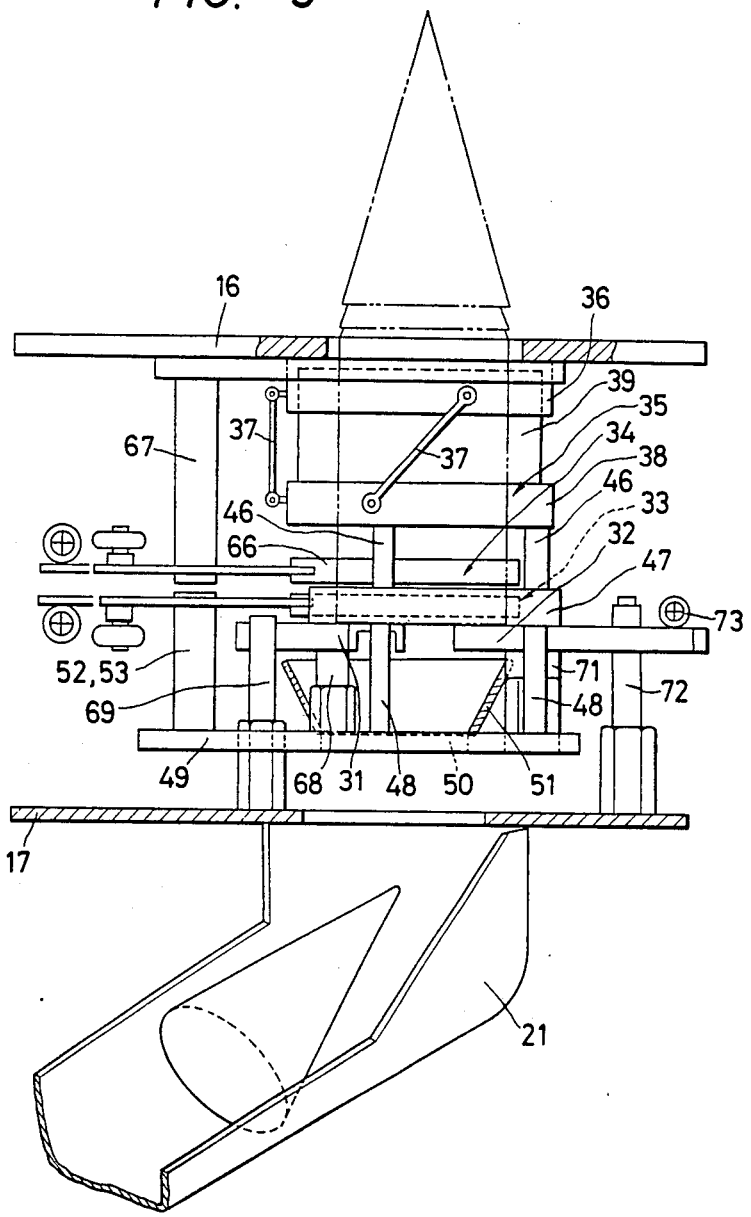
FIG. 5 is a front elevational view of a releasing section 20.

Now, the paper tubes releasing section 20 will be described. Referring to FIGS. 4 and 5, the releasing section 20 includes divided movable stoppers 31 and 32 for supporting paper tubes K thereon, a first chucker mechanism 33 for grasping only a lowermost one of the paper tubes, a second chucker mechanism 34 for grasping a second lowermost one of the paper tubes, and a drawer mechanism 35 for lowering the first chucker mechanism while entirely rotating the same by a fixed angle.

Figure 6:
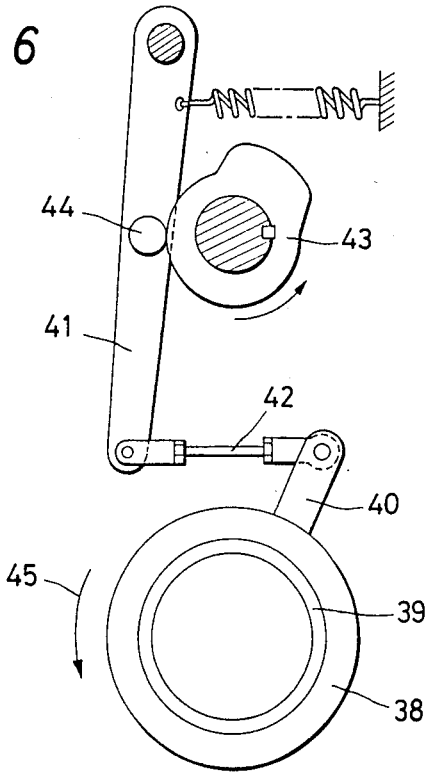
FIG. 6 is a plan view of a drawer mechanism.
Figure 7:
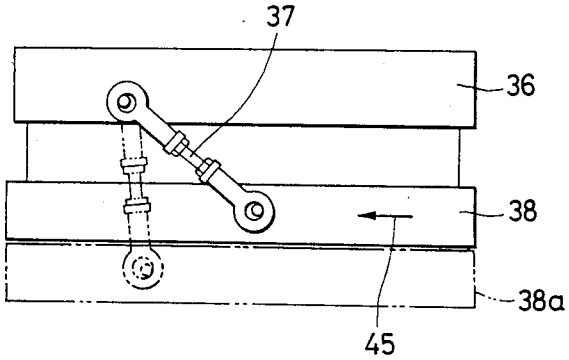
FIG. 7 is a front elevational view showing operations of a movable cylindrical member 38.
Figure 8:
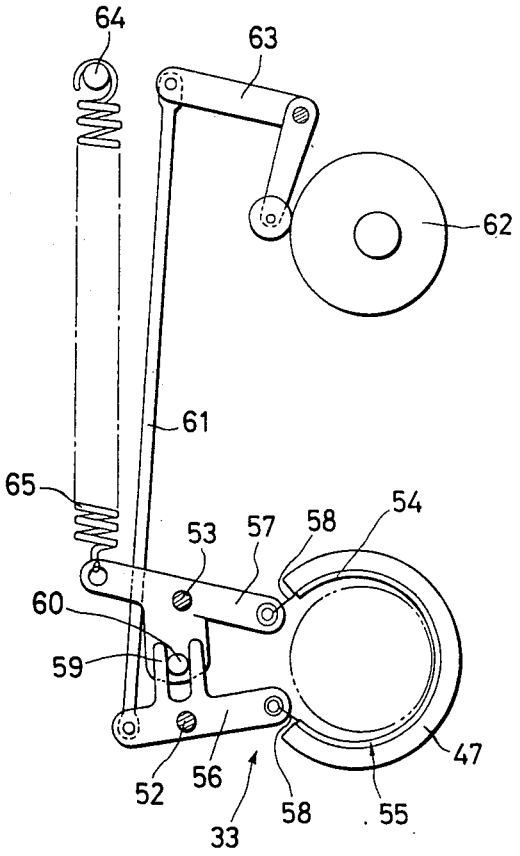
FIG. 8 is a plan view of a chucker mechanism.

The drawer mechanism 35 includes a fixed cylindrical member 36 secured to the bottom face of the partition plate 16, and a movable cylindrical member 38 supported on and depending from the fixed cylindrical member 36 by means of connecting rods 37 such that the movable cylindrical member 38 may move in vertical and rotational directions. The connecting rods 37 are connected in inclined positions between the two cylindrical members 36, 38. Accordingly, if a driving force is applied in a direction to rotate the movable cylindrical member 38 by a certain angle, then the cylindrical member 38 will slide downwardly along a guide cylinder 39. In particular, referring to FIGS. 6 and 7, a rod 42 is connected between a cam lever 41 and a projection 40 secured to a portion of the movable cylindrical member 38. Upon rotation of a drawer cam 43, a cam follower 44 on the cam lever 41 will follow the drawer cam 43 to rotate the movable cylindrical member 38 by a fixed angle in a direction of an arrow mark 45 around the guide cylinder 39. As a result, the movable cylindrical member 38 will move down to a lowered position **38*a* as indicated in a two dots and dash line in FIG. 7 by the rotation thereof in the direction of the arrow mark 45 and by an action of the connecting rods 37. Referring again to FIG. 5, an outer peripheral surface of the guide cylinder 39 serves as a guide surface for the movable cylinder 38 while an inner peripheral surface thereof serves as a guide surface for a paper tube when it drops. Further, a horse-shoe-shaped chuck guide 47 is secured to the bottom end face of the movable cylindrical member 38 by means of posts 46, and a flat plate 49 is securely supported on the bottom end face of the chuck guide 47 by means of further posts 48. The flat plate 49 has a hole 50 through which a paper tube can pass, and a funnel-shaped paper tube guide 51 for guiding a paper tube is secured in the hole 50 of the flat plate 49. Rods 52 and 53 are mounted uprightly on the flat plate 49, and a first chucker is supported on the rods 52, 53. In particular, referring to FIGS. 5 and 8, a chucker 55 is located within the horse-shoe shaped chuck guide 47 and includes a spring steel member 54 which has a member of a friction material such as a rubber, leather and so on, secured to an inner peripheral surface thereof. Connecting members 58 are connected between opposite ends of the chucker 55 and levers 56, 57. The levers 56, 57 are mounted for pivotal motion around rods 52, 53, respectively, supported on the flat plate 49. The lever 56 has a bifurcated or forked portion 59 which is engaged with a pin 60 mounted on the other lever 57 in order to establish operative connection between both levers 56, 57. A rod 61 is connected to the lever 56 and also to a cam lever 65 which is disposed to follow a cam 62 for rocking motion thereby. A spring 65 extends between the lever 57 and a fixed pin 64 to urge the chucker 55 in its closing direction. The chucker 62 is allowed to open by operation of the cam 62**.

It is to be noted that, while details of a second chucker 66 is not shown, it is similar in construction and operation to the first chucker, and a rod 67 of FIG. 5 for supporting the chucker 66 thereon is secured to and depends from the partition plate 16 so that the chucker 66 is stationary in its position. Therefore, the first chucker is different from the second chucker in that it is moved up and down by the drawer mechanism therefor.

Figure 9:
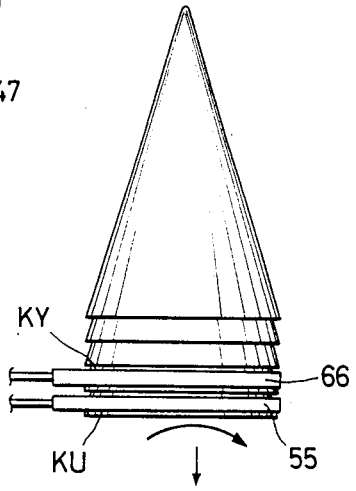
FIG. 9 is a front elevational view showing a releasing operation.

Accordingly, if the first chucker 55 is rotated and simultaneously moved down from a position as seen in FIG. 9 in which the first chucker 55 grasps a lowermost paper tube KU therein while the second chucker 66 grasps a second lowermost paper tube KY therein, only the lowermost paper tube KU closely fitted in the first chucker 55 can be separated from a heap of paper tubes above. Subsequently, if the first chucker 55 is loosened, then only one paper tube will drop downwardly therefrom.

Figure 10:
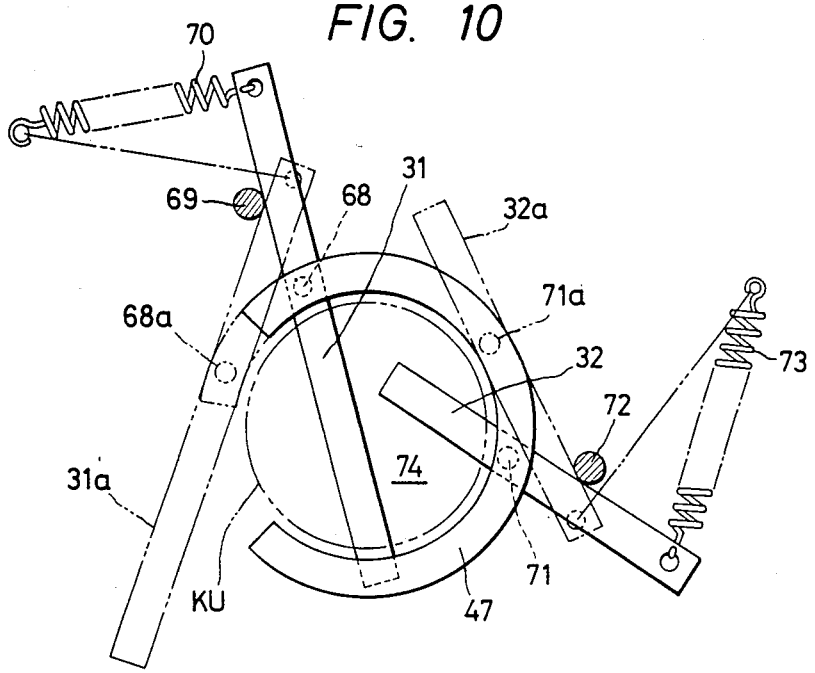
FIG. 10 is a plan view showing operations of stopper devices 31 and 32.

In the followings, description will be given, with reference to FIGS. 5 and 10, of a stopper device for positioning a lowermost paper tube to a position in which it is to be grasped by the first chucker. The aforementioned first stop lever 31 is supported for pivotal motion on a pivot 68 erected uprightly on the flat plate 49 which is mounted for up and down movement together with the movable cylindrical member 38 and the chuck guide 47. A spring 70 is connected to an end of the lever 31 and urges the lever 31 into contact with a pin 69 secured to the partition plate 17. Similarly, the second stop lever 32 is supported for pivotal motion on a pivot 71 integrally mounted on the chuck guide 47 and is urged into contact with a pin 72 on the flat plate 49 by means of a spring 73. Normally, the first and second stop levers 31, 32 are in respective positions as indicated by full lines in which they extend into a substantially circular area 74 as defined by an inner periphery of the chuck guide 47 so that a lowermost paper tube KU of a heap of paper tubes is received by the stop levers 31, 32. After the first chucker 55 has grasped the lowermost paper tube, the movable cylindrical member 38 is rotated a fixed angle together with the integral chucker guide 47 and the flat plate 49 until the pivots 68, 71 come to positions **68*a*, 71*a*, respectively, as indicated by two dots and dash lines in FIG. 10. As a result, since the pins 69, 72 are stationary, the stop levers 31, 32 are allowed to pivot to respective positions 31*a*, 32*a* as indicated by two dots and dash lines. If the first chucker 55 is loosened in this condition, only the lowermost paper tube will be allowed to drop onto the chute 21 passing through the paper tube guide 51 of FIG. 5**.

The magazine feeding driving section 19 will be described in the followings.

Figure 12:
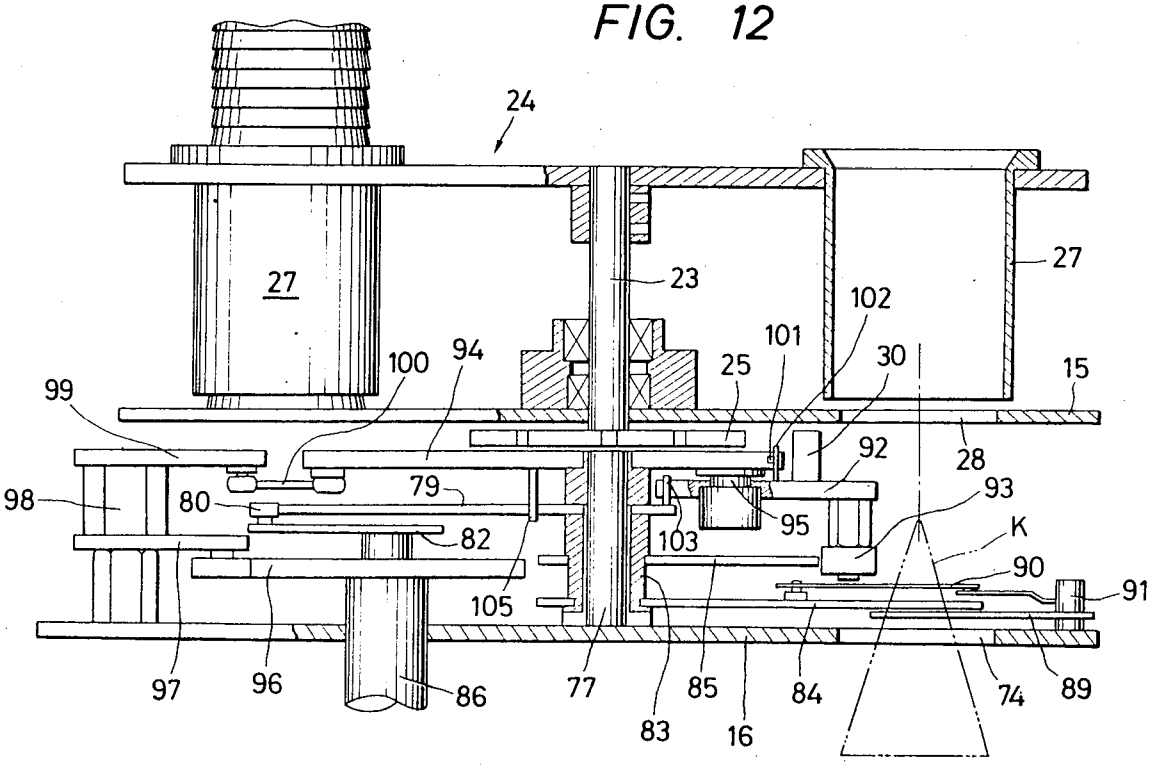
FIG. 12 is a front elevational sectional view of the same section.

Referring to FIGS. 11 and 12, a detection mechanism is provided which detects whether or not there is a paper tube K within a hole 74 which is formed in the partition plate 16 so as to allow a paper tube to pass therethrough. A clutch mechanism 76 is also provided which allows transmission of driving rotation to the magazine feeding latch wheel only when there is no paper tube within the hole 74.

The paper tube detection mechanism 75 includes a feeler 79 mounted for pivotal motion on a fixed pivot 77 and urged in a counterclockwise direction in FIG. 11 around the pivot 77 by means of a spring 78, a whirling lever 82 having a cam roller 81 supported thereon which is disposed to be brought into and out of contact with a cam face 80 on an end of the feeler 79, a paper tube detecting lever 84 mounted for integral motion with the feeler 79 by means of a hub 83 of FIG. 12, and a latch holding cam 85 mounted for integral pivotal motion with the paper tube detecting lever 84. Thus, if a cam shaft 86 is rotated one complete rotation in a counterclockwise direction in FIG. 11, the whirling lever 82 which is secured to the cam shaft 86 by means of a key 87 is whirled once. At the same time with the starting of the whirling of the lever 82, the feeler 79 is allowed to be pivoted in the counterclockwise direction around the shaft 77 by the spring 78. As a result, the paper tube detecting lever 84 follows the feeler 79 to also pivot integrally with the feeler 79 so that an inside edge 88 of the lever 84 passes over the hole 74 of the partition plate 16. An auxiliary lever 89 is mounted for pivotal motion about a fixed pivot 91 and is connected to the lever 84 by means of a connecting bar 90. When there is a paper tube in the hole 74, the levers 84 and 89 will clamp an outer periphery of the paper tube at opposite sides thereof to prevent displacement or dislocation of the paper tube in order to hold the paper tube in its regulated fixed position. Accordingly, if there is present a paper tube K which extends through the hole 74 as seen in FIG. 12, the detecting lever 84 will be abutted with the paper tube K and hence its pivotal motion (angle) will be limited thereby. If the pivotal motion of the detecting lever 84 is otherwise greater than a prescribed angle, i.e., due to absence of a paper tube, the latch holding cam 85 mounted for integral pivotal motion with the detecting lever 84 will kick a roller 93 on a clutch lever 92 which will be described hereinafter.

The clutch mechanism 76 includes a rocking lever 94 mounted for rocking motion within a fixed limited angle about a fixed pivot 77, the clutch lever 92 mounted for rocking motion around a pivot 95 depending from an end of the rocking lever 94, the roller 93 depending from a lower surface of the clutch lever 92, and the latch pin 30 uprightly erected on an upper surface of the clutch lever 92. The rocking lever 94 is driven by means of a mechanism including a cam lever 97 urged to be engaged with a cam 96 on the cam shaft 86, a lever 99 mounted for integral rocking motion with the cam lever 97 via a shaft 98, and a rod 100 connecting the lever 99 to the rocking lever 94.

A stopper 101 is provided on a side edge of the rocking lever 94 and disposed for engagement with a pin 102 on the clutch lever 92 while another stopper 103 is uprightly provided on the feeler 79 and disposed for engagement with a side edge 104 of the clutch lever 92. The stoppers 101 and 103 serve to define opposite limit positions of the clutch lever 92. The clutch lever 92 is rockable freely to any position between the limit positions defined by the stoppers 101, 103. A pin 105 is provided on a lower surface of the rocking lever 94 and is disposed for engagement with a side edge 106 of the feeler 79. Thus, when there is a paper tube present in the hole 74, the pin 105 operates to push the detecting lever 84 and the auxiliary lever 89, which are in their positions in which the paper tube is grasped therebetween, in a direction to temporarily loosen the levers 84 and 89 thereby to allow the lowermost paper tube to drop into the chute whereafter a paper tube grasped by the second chucker above is allowed to drop downwardly until it is received by and placed on the stop levers 31, 32 of FIG. 5.

Accordingly, if there is no paper tube present in the hole 74 shown in FIGS. 11 and 12, one complete rotation of the cam shaft 86 will move the whirling lever 82 away from the feeler 79 to allow the feeler 79 to be pivoted in a direction of an arrow mark 107 by a force of the spring 78 so that the paper tube detecting lever 84 and the latch holding cam 85 will be pivoted integrally with the feeler 79. Due to absence of any paper tube, the detecting lever 84 will be permitted to pivot a maximum angle in a direction of an arrow mark 108 whereupon the latch holding cam 85 will kick the roller 93 to pivot the clutch lever 92 in a direction of an arrow mark 109 about the shaft 92 so that the latch pin 30 on the clutch lever 92 will be engaged with a latch 29*a* of the latch wheel 25 secured to the rotary shaft 23 of the magazine 24. Consequently, the rocking lever 94 will be pivoted in the clockwise direction about the pivot 77 through the levers 97, 99 and the rod 100 by an action of the magazine cam 96 to revolve the clutch lever 92 around the pivot 77. As a result, the latch wheel 25 which is engaged with the latch pin 30 will be rotated one pitch in the clockwise direction to thus rotate the magazine 24 shown in FIG. 12 by one pitch to bring a cylindrical member 27 in which a number of paper tubes are heaped up into a tower-like form to a position adjacent the hole 28 of the partition plate 15 whereafter the paper tubes within the bottomless cylindrical member 27 will be allowed to drop therefrom and be once received by and placed on the detecting lever 84 (FIG. 13).

Figure 14:
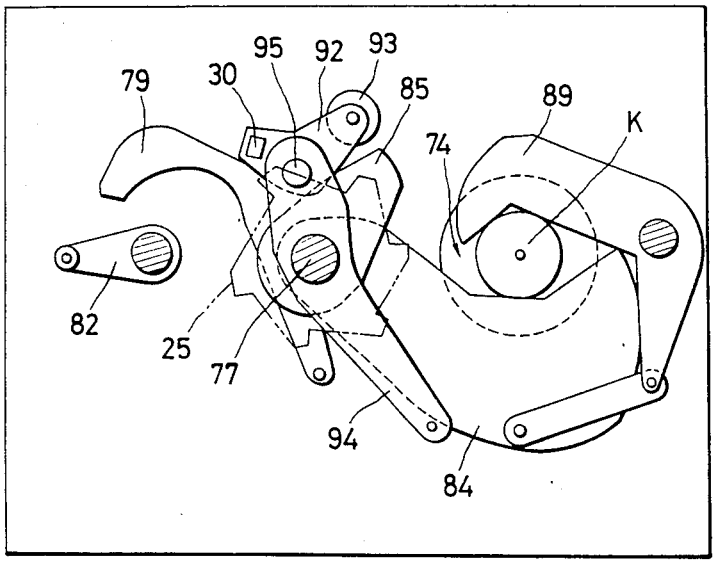
FIG. 14 is a similar plan view but showing operations of the driving section when there is a paper tube present.

It is to be noted, however, that, when there is present a paper tube in the hole 74, the paper tube K will prevent pivotal motion of the detecting lever 84 thereby to prevent the latch holding cam 85 from pivoting to a position at which it kicks the roller 93 of the clutch lever 92, and hence the latch pin 30 will not engage with the latch wheel 25 and thus the latch wheel 25 will not be rotated even by rocking motion of the rocking lever 94 so that rotation of the magazine 24 will not be caused (FIG. 14).

Figure 15:
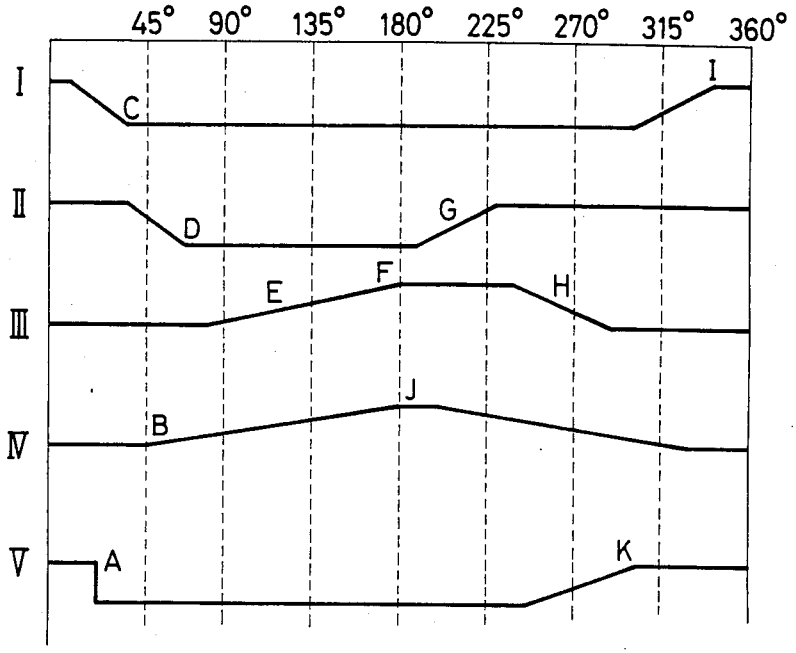
FIG. 15 is a time chart showing operations of the discharging device.

Operations of the first and second chuckers 55, 66, the drawer driving cam 43, the magazine cam 96 and the feeler 79 of the above-described paper tube discharging device 13 are diagrammatically illustrated in the time chart of FIG. 15. In FIG. 15, I, II, III, IV and V designate the operation of the second chucker, first chucker, drawer, magazine and feeler, respectively. In particular, a motor 110 as shown in FIG. 4 is energized in response to a paper tube supplying instruction to rotate the cam shaft 86 one complete rotation by way of gears 111 and 112. During the rotation, the feeler 79 shown in FIG. 11 is first pivoted in the direction shown by the arrow mark 107 in order to effect a detecting operation as described above (A), and then the rocking lever 94 is pivoted a fixed angle by operation of the magazine 24 rotating cam 96 whereupon the rotation of the magazine is controlled depending upon whether or not there is present a paper tube in the hole 74 (B). In the meantime, the second chucker 66 of the releasing section 20 is closed to grasp a second lowermost paper tube (C) whereafter the first chucker 55 grasps a lowermost paper tube (D). Then, the movable cylindrical member 38 is rotated a fixed angle and simultaneously lowered by operation of the drawer cam (E) to separate the paper tube grasped by the first chucker 55 from paper tubes above (F). Subsequently, the first chucker 55 is loosened to allow the thus separated paper tube to drop into the chute (G), and then after the movable cylinderical member 38 has been moved up (H), the second chucker 66 is loosened (I) to allow the remaining paper tubes to drop onto the stoppers 31, 32 shown in FIG. 4.

Figure 13:
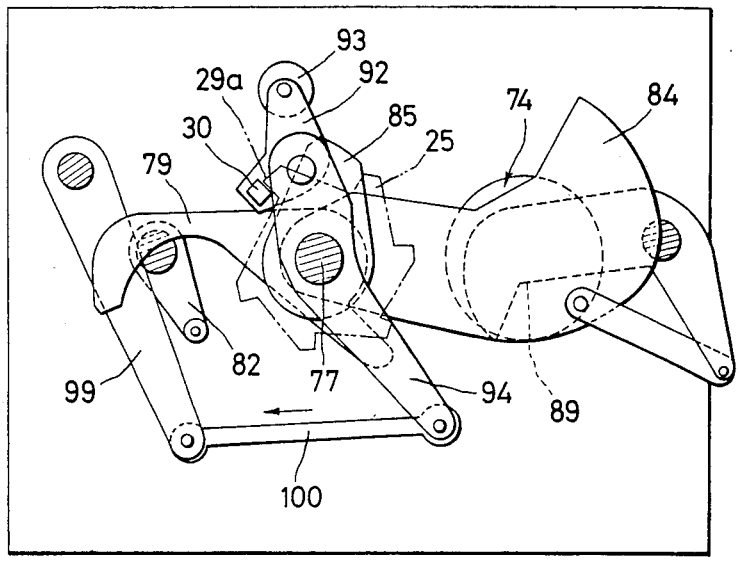
FIG. 13 is a plan view showing operations of the driving section of FIG. 11 when there is no paper tube present.

It is to be noted that, when there is no paper tube present in the hole 74 shown in FIG. 11, the releasing section will effect idling by one complete rotation of the cam shaft 86 and the magazine 24 will be rotated one pitch (J) to allow a new heap of paper spools to be thrown into the hole 74 and to be once received by and placed on the paper tube detecting lever 84 shown in FIG. 13 as described above. Then, after the movable cylindrical member 38 of the drawer mechanism has been moved up back to its original position (H), the feeler 79 shown in FIG. 11 is pushed by the lever 82 to return to its original position thereby to cause the detecting levers 84, 89 to be opened (K) to allow a heap of paper tubes on the levers to drop therefrom onto the stoppers 31, 32 below so as to be received by and placed on the stoppers for preparation for a subsequent next releasing operation.

Figure 16:
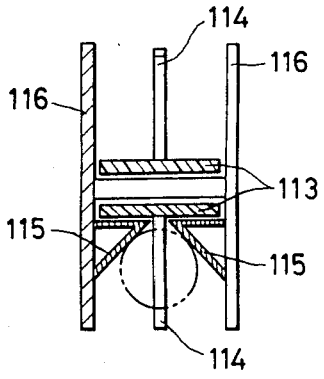
FIG. 16 is a horizontal cross sectional view of a transporting path 14*a*.
Figure 17:
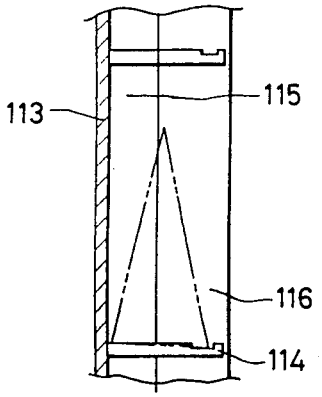
FIG. 17 is a partial vertical cross sectional view of the transporting path.

A paper tube discharged by the discharging device as described above is supplied to the paper tube transporting device 14 by way of the chute 21. The paper tube transporting device 14 includes, as shown in FIGS. 16 and 17, a conveyor belt 113 which runs between the discharging device 13 and the position 14 at which paper tubes are supplied to the travelling car 8, paper tube receiving pins 114 provided to extend laterally from mid portions of the conveyor belt 113, guide plates 115 for controlling orientation of paper tubes on the pins 114, and outer frames 116 to which the guide plates 115 are secured. Since a paper tube K thrown out from the chute 21 drops with its larger diameter portion directed downwardly, it will be received on a horizontal pin 114 in a stand-by position by cooperation of the pin 114 with the guide plates 115. The paper tube K will then be fed to the supplying position to the travelling car 8 along a vertical transporting path 14*a* and a horizontal transporting path 14*b* by feeding (pitch feeding) of the conveyor belt 113.

Accordingly, if a number of tapered paper tubes heaped up one on another into a tower-like form are contained in the magazine, they will be discharged therefrom one after another in response to a paper tube supplying instruction from a winder and automatically supplied to the winder by a transporting conveyor. For example, if it is assumed that each of the six cylindrical members of the paper tube magazine of the present embodiment can contain therein a heap of up to 50 paper pipes, a total of up to 300 paper tubes can be contained in the discharging device. And if a doffer provided on the travelling car shown in FIG. 1 can doff up to 60 fully wound packages every hour, then automatic running is possible for a period of five hours. Morever, if the capacity of the discharging device for containing paper tubes is increased, i.e., either if the number of the paper tube containing cylindrical members of the magazine is increased or if the number of paper tubes included in each heap is increased, continuous automatic running for automatic doffing and supplying of paper tubes can be further elongated thereby.

It is to be noted that, while the present application discloses an example in which paper tubes are supplied to a single travelling car which travels along winding units of a winder, in case the number of winding units is significantly greater, it is possible to employ two travelling cars to which paper tubes are supplied in a similar manner at fixed positions of the two travelling cars.

Besides, the system of the present application can be possibly modified such that a travelling car has only a doffer thereon without provision of a paper tube containing box while a paper tube stock device is provided to each winding unit instead so that paper tubes discharged from a discharging device may be supplied to the paper tube stock device of each winding unit. In particular, the horizontal transporting path 14*b* shown in FIG. 3 may be extended all over the winding units and a movable gate may be provided at a position adjacent each winding unit in such a manner that it will alternatively allow paper tubes to be supplied to or pass by the winding unit.

As apparent from the foregoing description, a paper tube supply system according to the present invention comprises, between a winder including a plurality of winding units therein and a paper tube discharging device including a stock section for retaining tapered paper tubes in heaped up conditions and a releasing section for separating lowermost ones of the heaped up paper tubes in said stock section from the remaining paper tubes above, a paper tube transporting path for feeding therealong the thus separated paper tubes one by one. Accordingly, only if paper tubes in a large quantity are stocked in the paper tube discharging device, supply of paper tubes to every winding unit of the winder can be effected automatically. Besides, the system of the invention can deal flexibly in any desired form with any case such as when supply of paper tubes to a winder is effected with a travelling car or when paper tubes are supplied to a stock device provided for each winding unit. Particularly, the present system enables orientation of paper tubes and assured separation and supply of a heap of paper tubes which are problems to be resolved regarding supply of tapered paper tubes.

We claim:

1. A paper tube supply system for supplying a paper tube stored in a vertical stack of paper tubes to an automatic winder having a plurality of winding units, said system comprising:

a paper tube discharging means for separating the lowermost one of said tubes from said vertical stack of paper tubes;

a paper tube delivering means for delivering said separated paper tube to one of said winding units;

a paper tube conveying means for conveying said separated paper tube from said paper tube discharging means to said paper tube delivering means, wherein said paper tube conveying means further comprises:

a continuous conveyor belt having a first section on which said tube is transported substantially vertically and a second section on which said tube is transported substantially horizontally, said conveyor belt comprising guide means for maintaining said tube in the same relative orientation with respect to said conveyor on both said first and second sections of said conveyor belt; and wherein said paper tube delivering means further comprises:

a pair of ceiling rails adjacent to and suspended above said plurality of winding units;

a car having a plurality of wheels supported and guided by said ceiling rails to thereby enable said car to travel along said ceiling rails to each of said winding units; and wherein said paper tube discharging means further comprises:

a first horizontal partition plate provided with a through-hole of sufficient size to allow said vertical stack of paper tubes to pass therethrough;

a vertical shaft extending through said partition plate, said shaft being supported for rotation with respect to said partition plate by means of bearings;

a disk secured to one end of said shaft above said partition plate, said disk having a plurality of hollow cylinders disposed therein in circumferentially equally spaced relationship, one or more of said hollow cylinders containing said vertical stack of paper tubes; and a latch wheel secured to said shaft, said latch wheel being provided with a plurality of latches therearound for stopping rotation of said disk at a position at which one of said cylinders lies above said through-hole to thereby enable said vertical stack of paper tubes within said cylinder drop to through said through-hole.

2. A paper supply system according to claim 1, wherein said paper tube discharging means further comprises:

a movable stopper positioned below said first partition plate for supporting said vertical stack of paper tubes thereon;

a first chucker disposed above said movable stopper for gripping the lowermost paper tube of said vertical stack of paper tubes;

a second chucker disposed above said first chucker for gripping the next lowermost paper tube of said vertical stack of paper tubes; and a drawer means for lowering and rotating said first chucker by a fixed angle with respect to said second chucker.

3. A paper tube supply system according to claim 2, wherein said paper discharging means further comprises:

a second horizontal partition plate provided with a through-hole of sufficient size to allow said vertical stack of paper tubes to pass therethrough;

a fixed cylindrical member secured to the lower face of said second partition plate;

a movable cylindrical member supported on and depending from said fixed cylindrical member by means of inclined connecting rods, said movable cylindrical member being capable of moving vertically and rotationally with respect to said fixed cylindrical member; and a guide cylinder inserted within said fixed cylindrical member and said movable cylindrical member, such that said movable cylindrical member may slide downwardly and upwardly along said guide cylinder when a driving force is applied in a direction to rotate the movable cylindrical member.

4. A paper tube supply system according to claim 3, wherein said paper discharging means further comprises:

a detection means for detecting the absence of a paper tube in said through-hole of said second horizontal partition plate; and a clutch means responsive to said detection means for allowing transmission of driving rotation to said disk secured to said shaft when the absence of a paper tube is detected within said through-hole.

* * * * *